US007401914B2

(12) United States Patent
Yokoi

(10) Patent No.: US 7,401,914 B2
(45) Date of Patent: Jul. 22, 2008

(54) PRINTING APPARATUS AND METHOD FOR CONTROLLING PRINTING APPARATUS

(75) Inventor: Katsuyuki Yokoi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 403 days.

(21) Appl. No.: 11/146,166

(22) Filed: Jun. 7, 2005

(65) Prior Publication Data

US 2005/0280685 A1 Dec. 22, 2005

(30) Foreign Application Priority Data

Jun. 14, 2004 (JP) ..... 2004-176209

(51) Int. Cl.
*B41J 2/01* (2006.01)

(52) U.S. Cl. ..... 347/104; 347/101

(58) Field of Classification Search ..... 346/104; 399/374, 364; 347/101, 104
See application file for complete search history.

(56) References Cited

U.S. PATENT DOCUMENTS 4,453,841 A * 6/1984 Bobick et al. ..... 347/16
4,924,275 A * 5/1990 Nelson ..... 399/401
5,060,025 A * 10/1991 Kummel et al. ..... 399/401
5,764,245 A 6/1998 Yokoi
5,954,436 A * 9/1999 Kageyama et al. ..... 400/188
5,988,906 A * 11/1999 Arcaro et al. ..... 400/636.2
6,167,231 A * 12/2000 Blackman et al. ..... 399/364
6,719,469 B2 * 4/2004 Yasui et al. ..... 400/603
6,952,274 B2 * 10/2005 Tomitaka ..... 358/1.1
7,190,916 B2 * 3/2007 Yoshizawa ..... 399/82
2002/0015172 A1 * 2/2002 Sugita ..... 358/1.13
2004/0179053 A1 * 9/2004 Itoh ..... 347/16

FOREIGN PATENT DOCUMENTS

| | | |
|---|---|---|
| JP | 07-323637 | 12/1995 |
| JP | 09-327950 | 12/1997 |
| JP | 2002-059598 | 2/2002 |
| JP | 2003-308183 | 10/2003 |

* cited by examiner

*Primary Examiner*—Manish S Shah
(74) *Attorney, Agent, or Firm*—Fitzpatrick, Cella, Harper & Scinto

(57) ABSTRACT

If a plurality of print jobs is received irregularly, this invention makes it possible to perform a proper double-sided printing on a print medium. The printing apparatus of this invention comprises: print medium transport unit; printing means; discharge unit for discharging the print medium from the transport path; and double-sided printing control unit for controlling these unit. When the printing of a last page of print data based on a preceding print command is ended on the first surface of a print medium, the double-sided printing control unit does not discharge the print medium and has the print medium, whose first surface was printed, stand by in the transport path. Then, when the next print command is input, a first page of print data in the next print command is printed on the second surface of the print medium.

11 Claims, 6 Drawing Sheets

PRINTING APPARATUS AND METHOD FOR CONTROLLING PRINTING APPARATUS

BACKGROUND OF THE INVENTION

1. Field of the Invention

The present invention relates to a printing apparatus capable of a double-sided printing, which prints on both surfaces of a print medium, and also to a method for controlling such a printing apparatus.

2. Description of the Related Art

There has been known a printing apparatus capable of performing not only a one-sided printing, which prints on only one surface of a print medium, but also a double-sided printing, which successively prints on both front and back surfaces of the print medium fed from a supply unit. Example constructions of such a printing apparatus are disclosed in Japanese Patent Application Laid-open Nos. 7-323637, 9-327950 and 2002-59598.

Japanese Patent Application Laid-open No. 7-323637 (see FIG. 1 and FIG. 4) discloses a construction of a paper transport path in an ink jet printer or serial printer which allows a print medium to be printed on the back surface following the front surface printing. This official gazette also discloses a correspondence between print data and a print head.

Japanese Patent Application Laid-open No. 9-327950 (see FIG. 1) discloses an ink jet printer in which a paper transport path and a loop-shaped reversing transport path are merged in front of the print head. In this ink jet printer, a print head is installed at a common transport path following the merged portion of the two transport paths. By feeding a print medium past the print head in the forward direction, a one-sided printing is performed on one surface (the front surface). The print medium with one surface printed is then fed in the opposite direction through the reversing transport path for inversion, after which the inverted print medium is again printed now on the other surface (back surface) by the print head.

Japanese Patent Application Laid-open No. 2002-59598 (see FIG. 1) discloses a construction in which a print medium, after being printed on one surface, is transported by a transport belt for front/back inversion and then transported to the print head that prints on the back surface.

Further, Japanese Patent Application Laid-open No. 2003-308183 (see FIG. 18) discloses a printing apparatus control method that processes a plurality of print commands in the printing apparatus capable of double-sided printing.

Here, a common control sequence for a printing apparatus capable of double-sided printing is shown in FIG. 6.

In FIG. 6, when a print job is instructed by a host computer, a check is made to see if a double-sided printing is specified in the job instruction (S601).

When the double-sided printing is specified, a print medium is supplied from a supply unit (S602) and printing is performed on a front surface of the supplied print medium (S603). Then, the sheet that was printed on one surface is fed through the reversing transport path for inversion and the inverted sheet is fed again (S604). It is checked whether there is print data to be printed (S605). If there is print data, the print data is printed on the back surface (S606). The print mediums that have undergone printing are discharged out of the printing apparatus (S607). A check is made to see if there is still print data (S608). If print data exists, another sheet is supplied from the supply unit and is printed first on the front surface (S602-S607).

In a step S605 for checking the presence or absence of print data after the inverted sheet is supplied, if it is decided that data does not exist, the sheet is discharged. The control sequence checks the presence or absence of print data only after the sheet has undergone the front surface printing and the front/back inversion, for the following reason. Suppose that a print medium, after being printed on the front surface, is discharged as is. When sequential pages are successively printed on both surfaces of a plurality of sheets, the order of the page number on the last discharged sheet does not conform with that of the remaining sheets. To prevent this irregularity, the above control sequence is adopted.

Further, in FIG. 6, when a one-sided printing is specified in step S601, a sequence of processing that needs to be executed involves supplying a sheet from the supply unit, printing on one surface and discharging the printed sheet, in that order (S610-S613).

In step S609, when the specified print job is finished, the control program waits until the next print job is received, regardless of whether the last print job specified a double-sided printing or a one-sided printing. When a new print job is received, a check is made to see if the print job specifies the double-sided printing (S601), before starting the printing sequence.

The printing apparatus described in the above patent documents that can perform a double-sided printing are all designed to perform printing and discharging according the printing specification in a print job. Thus, in the above printing apparatus, the double-sided printing function is not fully utilized, giving rise to a problem of increased consumption of print media.

That is, in the printing apparatus described in the above patent documents, even if a double-sided printing is set, a reception of a print job containing only one page of print data results in a sheet discharge immediately following the printing on the front surface. Thus, when a print job for one page of data is received repetitively, as many print mediums printed on one surface as the print jobs are discharged even if the double-sided printing is set, thus consuming the same number of sheets as when the one-sided printing is set.

Japanese Patent Application Laid-open No. 2003-308183, proposes a printing apparatus which accumulates a plurality of print jobs in a memory means in the apparatus, making it possible to ignore the printing specification of each print job in executing a one-sided or double-sided printing. However, since this apparatus needs to accumulate print jobs successively in a memory means, there is a drawback that this arrangement can only be applied to those print jobs that are scheduled in advance.

When, for example, one connects to the Internet and prints relevant information as he or she views various home pages, a double-sided printing is not executed because printing is initiated as print jobs are received irregularly. As a result, a large number of print mediums is consumed, making it impossible to take full advantage of the double-sided printing function. As a memory means to store print jobs, semiconductor memories and hard disks are commonly used. Increasing the capacity of these memory means to accommodate a greater number of print jobs, however, raises another problem of a substantial increase in the cost of the printing apparatus.

SUMMARY OF THE INVENTION

An object of this invention is to provide a printing apparatus and a printing apparatus control method with high level of usability and economy, which can effectively utilize a double-sided printing function and thereby properly execute a double-sided printing on a print medium even when a plurality of print jobs are received irregularly.

To achieve this objective, this invention is characterized by the following aspects.

That is, according to a first aspect, the invention provides a printing apparatus comprising a transport means for transporting a print medium along a transport path; printing means for printing on the print medium at a predetermined print position in the transport path; discharge means for discharging the print medium from the transport path; and double-sided printing control means for controlling the transport means, the printing means and the discharge means to execute a double-sided printing to print on a first surface and a second surface of the print medium; wherein the double-sided printing control means can select between a first mode and a second mode, wherein, in the first mode, the double-sided printing control means discharges all print mediums that have been printed according to a print command, wherein, in the second mode, when the printing of a last page of print data based on a preceding print command is ended on the first surface of a print medium, the double-sided printing control means does not discharge the print medium by the discharge means, but makes the print medium, whose first surface was printed, stand by in the transport path to wait for an input of a next print command, and prints a first page of print data based on the next print command on the second surface of the print medium that was standing by.

According to a second aspect, the invention provides a printing apparatus comprising: transport means for transporting a print medium along a transport path; printing means for printing on the print medium at a predetermined print position in the transport path; discharge means for discharging the print medium from the transport path; and double-sided printing control means for controlling the transport means, the printing means and the discharge means to execute a double-sided printing to print on a first surface and a second surface of the print medium; wherein, when the printing of a last page of print data based on a preceding print command is ended on the first surface of a print medium, the double-sided printing control means does not discharge the print medium by the discharge means, but makes the print medium, whose first surface was printed, stand by in the transport path and, if a next print command is input, prints a first page of print data based on the next print command on the second surface of the print medium that was standing by.

According to a third aspect, the invention provides a method for controlling a printing apparatus, wherein the printing apparatus includes: transport means for transporting a print medium along a transport path; printing means for printing on the print medium at a predetermined print position in the transport path; discharge means for discharging the print medium from the transport path; and double-sided printing control means for controlling the transport means, the printing means and the discharge means to execute a double-sided printing to print on a first surface and a second surface of the print medium; the printing apparatus control method comprising the step of: selecting one of a plurality of modes, including a first mode and a second mode, to execute the double-sided printing; wherein the first mode is a mode in which all print mediums that have been printed according to a print command are discharged by the discharge means; wherein the second mode is a mode in which, when the printing of a last page of print data based on a preceding print command is ended on the first surface of a print medium, the print medium whose first surface was printed is not discharged by the discharge means and is made to stand by in the transport path to wait for an input of a next print command, and a first page of print data based on the next print command is printed on the second surface of the print medium that was standing by.

According to a forth aspect, the invention provides a method for controlling a printing apparatus, wherein the printing apparatus includes: transport means for transporting a print medium along a transport path; printing means for printing on the print medium at a predetermined print position in the transport path; discharge means for discharging the print medium from the transport path; and double-sided printing control means for controlling the transport means, the printing means and the discharge means to execute a double-sided printing to print on a first surface and a second surface of the print medium; the printing apparatus control method comprising the step of: controlling the transport means, the printing means and the discharge means by the double-sided printing control means so that when the printing of a last page of print data based on a preceding print command is ended on the first surface of a print medium, the print medium whose first surface was printed is not discharged by the discharge means but is made to stand by in the transport path to wait for an input of a next print command, and print data based on the next print command is printed on the print medium that was standing by.

In this invention, the first surface means one of the two surfaces of a print medium that is printed first. This is also called a front surface in the following description. The second surface of the print medium means a surface that is printed following the first surface and this is also called a back surface in the following description.

With this invention, even if a plurality of print jobs are received irregularly, print mediums are prevented from being discharged each time individual print jobs are executed. This allows the double-sided printing to be performed consecutively for a plurality of print jobs. Therefore, this invention can reduce the consumption of print medium significantly when compared with the conventional apparatus. At the same time it is not necessary to provide a memory means of large capacity to store a plurality of print jobs in advance as it has been with the conventional apparatus. These in turn make the construction of the apparatus less expensive and greatly improve usability and economy of the printing apparatus Furthermore, in the double-sided printing active state the user can selectively discharge a print medium after the sheet has undergone only the front surface printing, in order to terminate the double-side printing. This provides a printing apparatus with high usability which takes full advantage of the double-sided printing function.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, one embodiment of the present invention will be described.

First, the construction of a printing apparatus capable of a double-sided printing that applies the present invention will be explained. The printing apparatus used in this embodiment is a so-called serial-type ink jet printing apparatus which forms an image on a print medium by ejecting ink from a print head mounted on a carriage reciprocally scanned over the print medium.

Figure 2:
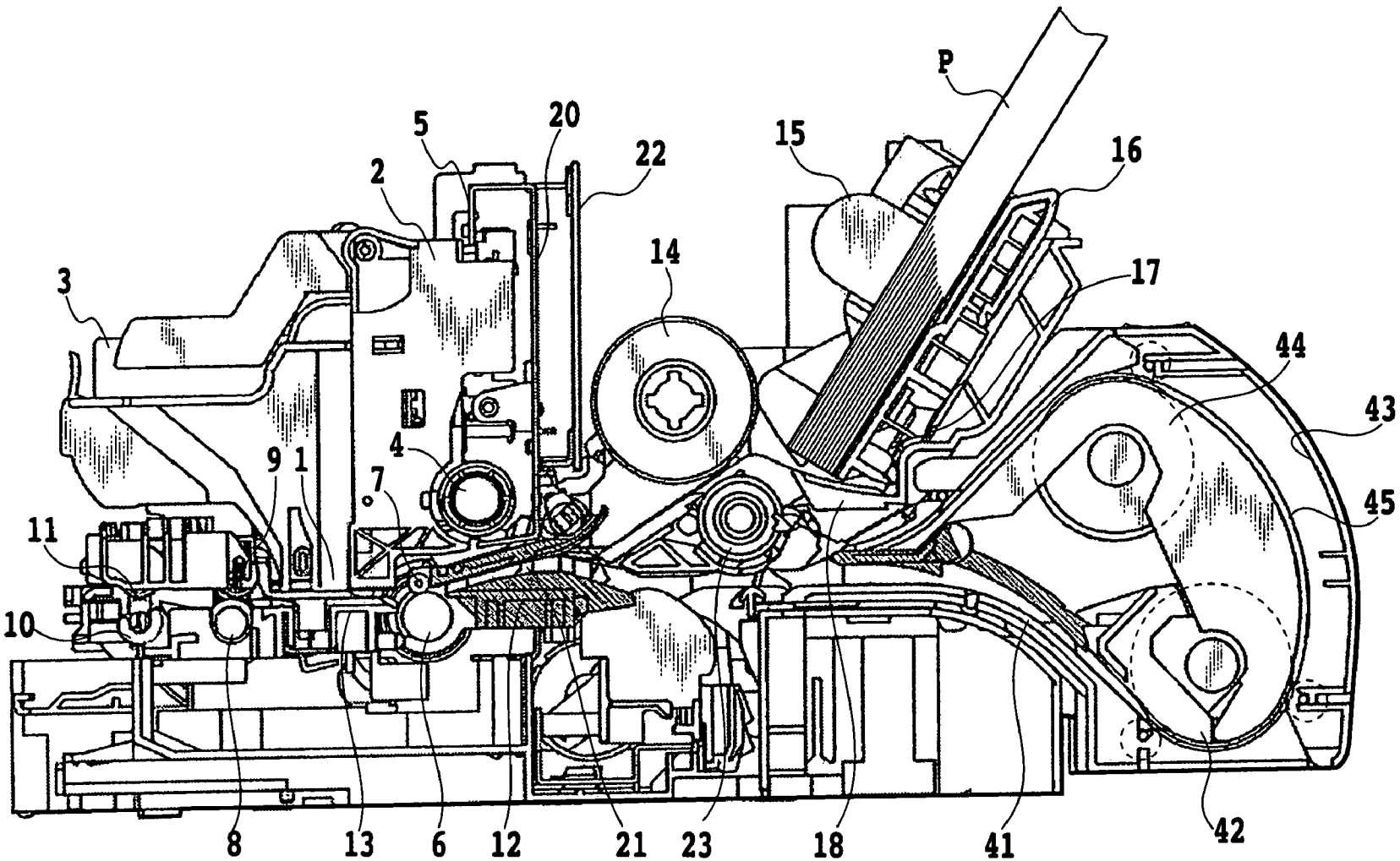
FIG. 2 is a vertical side cross-sectional view showing an inner construction of the printing apparatus in the embodiment of this invention.

FIG. 2 is a vertical side cross-sectional view showing an inner construction of the ink jet printing apparatus.

In FIG. 2, denoted 1 is a print head which as a printing means prints on a print medium 19 according to print data. The print head 1 in this embodiment is an ink jet print head that ejects ink onto a print medium for image forming. Designated 2 is a carriage that carries the print head 1 and reciprocally travels in a main scan direction (perpendicular to a plane of the drawing). An ink tank 3 supplies ink to the ink jet print head 1 mounted on the carriage 2. A carriage shaft 4 works as a guide for the carriage 2 to perform the main scan. A carriage guide 5 guides the carriage 2 along with the carriage shaft 4.

A transport roller 6 is installed upstream, in the print medium transport direction, of an area where the ink jet print head 1 performs printing on a print medium. A follower roller 7 rotates with the transport roller 6 as they hold and feed the print medium. A first discharge roller 8 is located downstream, in the print medium transport direction, of the area where the print head 1 prints on the print medium. A first discharge follower roller 9 rotates with the first discharge roller 8 as they grip the print medium. Denoted 10 is a second discharge roller 10 installed downstream of the first discharge roller 8 in the print medium transport direction. A second discharge follower roller 11 rotates with the second discharge roller 10 as they hold the print medium. Denoted 13 is a print medium support member installed at a print position where the print head 1 performs printing on the print medium. Designated 20 is a chassis that provides a structure of the printing apparatus.

Designated 15 is a paper stacker on which sheets of print medium P are stacked. A supply roller 14 supplies the print medium from the paper stacker 15 to the transport roller 6. A separation member 23 separates only one sheet at a time from a pile of print mediums placed on the paper stacker 15 as the print medium P is fed by the supply roller 14. A pressure plate 16 urges the sheets of print medium P stacked on the paper stacker 15 toward the supply roller 14. A pressure plate spring 17 produces a pressing force to urge the pressure plate 16 toward the supply roller 14. A paper guide member 18 guides a front end of the print medium P on the paper stacker 15 toward the supply roller 14 and the separation member 23. A guide member 12 guides the print medium fed by the supply roller 14 toward the transport roller 6.

Designated 41, 43 are reversing guide members that form a reversing loop path 45 which reverse the front and back surface of the print medium 19 after the front surface has been printed. Denoted 42, 44 are reversing rollers that transport the print medium in the reversing loop path 45.

A paper end sensor 21 is installed between the transport roller 6 and the supply roller 14 and detects when the front and rear end of the print medium pass and at the same time outputs a predetermined signal. Denoted 22 is a control unit which controls an overall operation of the printing apparatus, and its configuration will be described later by referring to FIG. 4.

Next, how the print medium moves when the printing apparatus of the above construction performs the double-sided printing will be explained by referring to FIG. 3A, FIG. 3B and FIG. 3C.

First, the behavior of the print medium, as a printing operation is performed on the front surface of the print medium, will be explained.

Figure 3A:
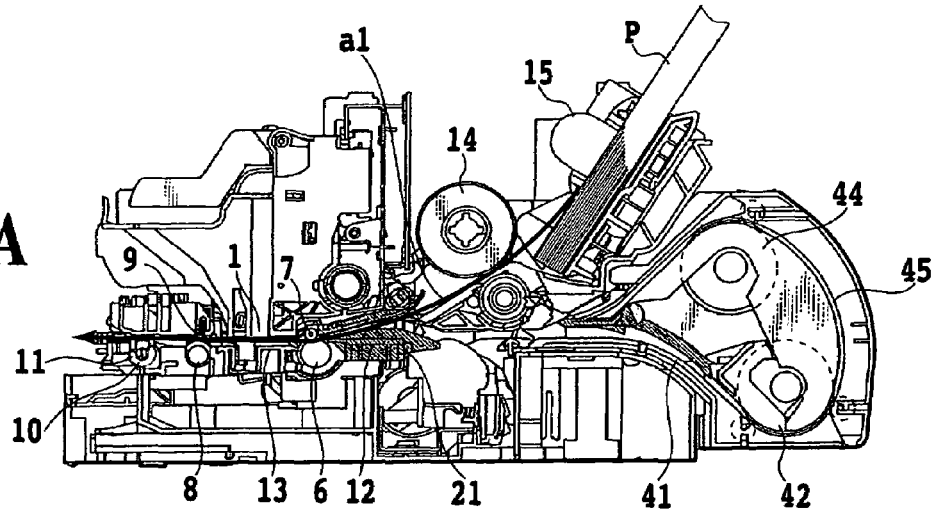
FIGS. 3A, 3B and 3C are vertical side cross-sectional views showing how a print medium moves during a double-sided printing performed by the printing apparatus in the embodiment of this invention.

In the front surface printing, the print medium P is transported along a path (first transport path) indicated by an arrow in FIG. 3A from the paper stacker 15, during which time the print head 1 prints on the front surface (first surface) of the print medium.

That is, the print medium P supplied from the paper stacker 15 by the supply roller 14 is guided along the guide member 12 and held between the transport roller 6 and the follower roller 7. Then, the print medium is fed by the rotation of these rollers 6, 7 onto the print medium support member 13 facing the print head 1. In the mean time, the paper end sensor 21 detects the front end of the print medium P and sends its output to the control unit 22. The control unit 22, upon receiving the detection signal from the paper end sensor 21, causes the carriage 2 together with the print head 1 to perform a main scan over the print medium P fed to the print medium support member 13 and at the same time causes the print head 1 to eject ink, thus progressively forming an image on the front surface of the print medium P.

The print medium P formed with an image by the print head 1 passes the print medium support member 13 and is held between the first discharge roller 8, that rotates in synchronism with the transport roller 6, and the first discharge follower roller 9 and then between the second discharge roller 10 provided downstream of the first discharge roller 8 in the transport direction and the second discharge follower roller 11. As these rollers rotate in the forward direction, the print medium P is moved toward a discharge unit. If the print medium P is to be printed on only the front surface, the print medium P is discharged out of the apparatus onto the discharge unit by the rotation of the second discharge roller 10 and the second discharge follower roller 11. During the double-sided printing, however, when the printing operation on the front surface of the print medium is completed, the rear end of the print medium P (in the transport direction during the front surface printing) is held between the discharge rollers 8, 10 and the discharge follower rollers 9, 11.

Next, the behavior of the print medium, when the print medium is printed on its back surface (second surface), will be explained.

Figure 3B:
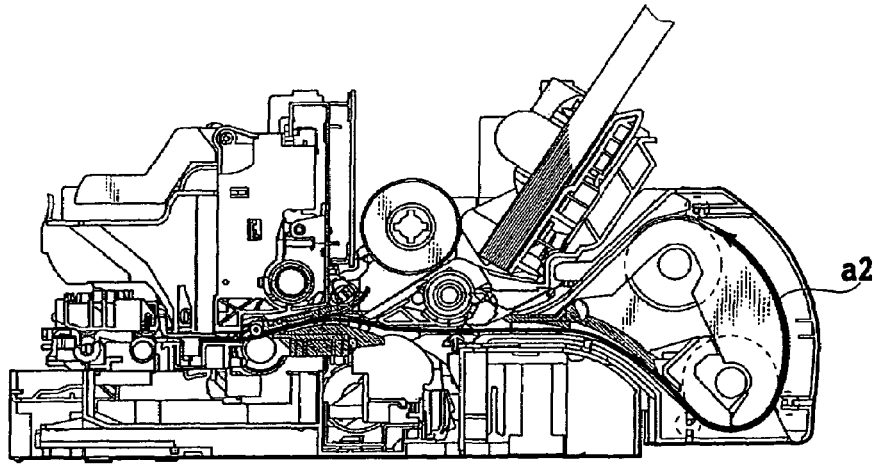
Figure 3C:
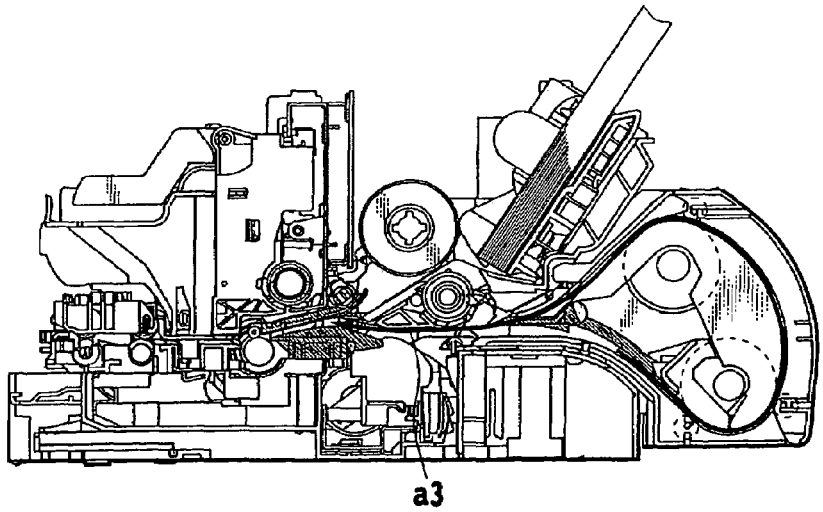

During the back surface printing, the print medium P held between the discharge rollers 8, 10 and the discharge follower rollers 9, 11 is now fed along a path (second transport path) indicated by arrow a2 and arrow a3 in FIG. 3B and FIG. 3C, during which time the print medium P is printed on its back surface by the print head 1.

That is, as the discharge rollers 8, 10 and the discharge follower rollers 9, 11, which hold the print medium P, are rotated in the backward direction, the print medium P is moved in a direction reverse to that of the front surface printing. The print medium P passes over the print medium support member 13 and is held between the transport roller 6 and the follower roller 7, both of which are rotating in the reverse direction. Then, the print medium P is fed by the rotation of these rollers into a reversing loop path 45 (see FIG. 3B).

The print medium that was fed into the reversing loop path 45 is transported through the reversing loop path 45 by the rotation of two reversing rollers 42, 44 installed in the path 45 toward the transport roller 6 and the follower roller 7 (see FIG. 3C). By this time the print medium P is turned upside down with the front and rear end reversed. The print medium P that has reached between the transport roller 6 and the follower roller 7 is held between them, whose rotating directions are already switched to the forward direction, and thus is fed to the print medium support member 13. The print head 1 performs printing according to the paper end detection timing of the paper end sensor 21 to form an image on the back surface of the print medium P. The print medium P printed on its back surface is now discharged onto the discharge unit not shown by the rotation of the first discharge roller 8 and first discharge follower roller 9 and of the second discharge roller 10 and second discharge follower roller 11.

Figure 4:
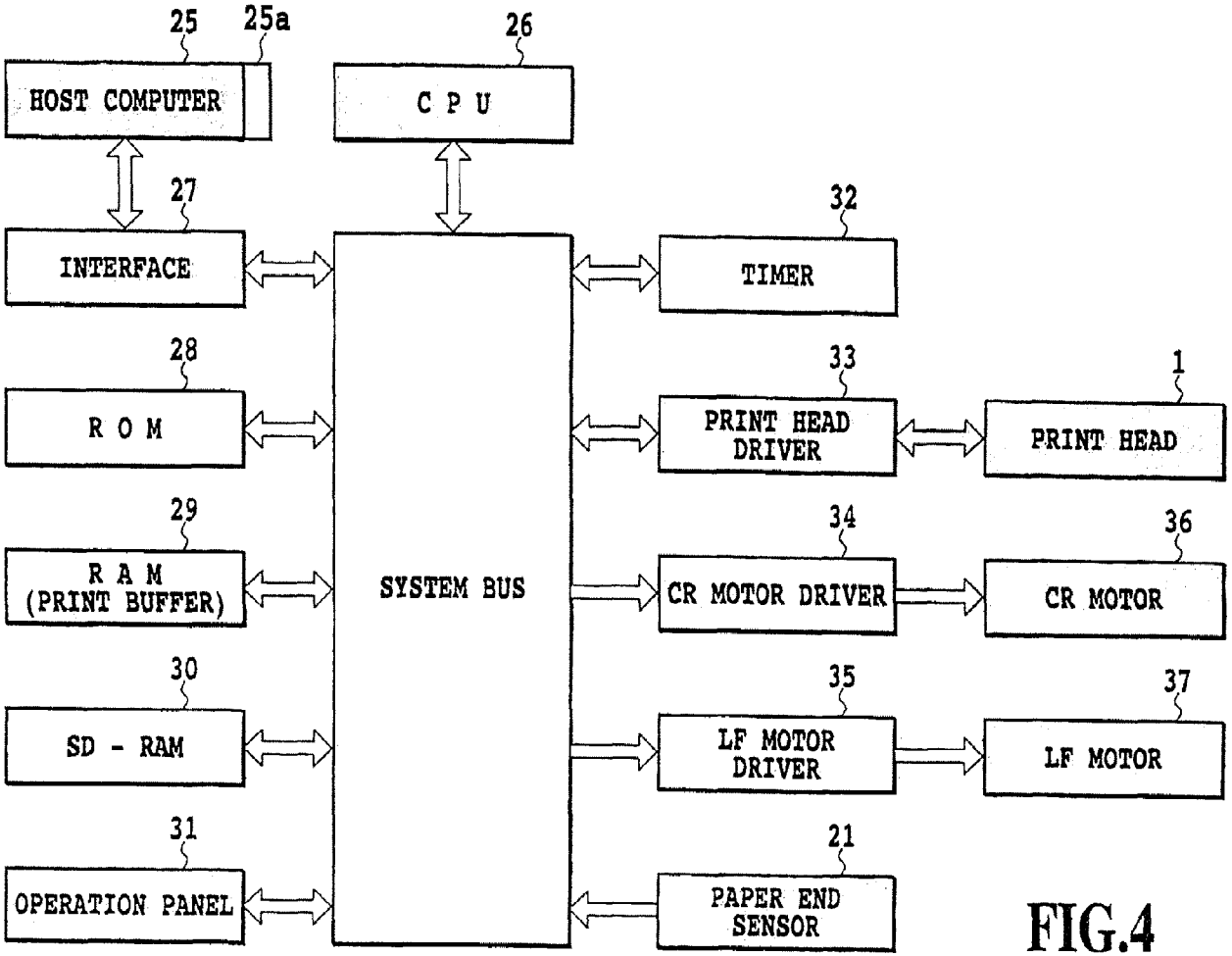
FIG. 4 is a block diagram showing a configuration of a control unit of the printing apparatus in the embodiment of this invention.

Next, the configuration of the control unit (control means) 22 of the printing apparatus in this embodiment will be described by referring to the block diagram of FIG. 4.

Designated 26 is a microprocessor-based CPU which is connected to a host computer 25 via an interface 27. The CPU 26 controls the printing operation according to a control program stored in a read-only-type program memory 28 (e.g., control program to execute the double-sided printing shown in FIG. 1) and print data sent from the host computer 25 and stored in a random-access:type buffer memory 29. That is, the CPU 26 based on the control program stored in the ROM 28 controls a CR motor 36 and a LF motor 37 through motor drivers 34, 35. Further, based on a control program stored in the ROM 28 and print information stored in the RAM 29, the CPU 26 controls the print head 1 through a head driver 33. The LF motor 37 may be a pulse motor or other type of motor that can count the amount of rotation, such as an encoded DC motor. The rotation of the LF motor 37 is transmitted, through a drive force transmission mechanism not shown, to the supply roller 14, transport roller 6, first discharge roller 8, second discharge roller 10 and reversing rollers 42, 44.

Denoted 30 is an SD-RAM, a rewritable, nonvolatile memory that retains information even when power supply is cut off. Denoted 31 is an operation panel to accept operations on the part of the user.

Figure 5:
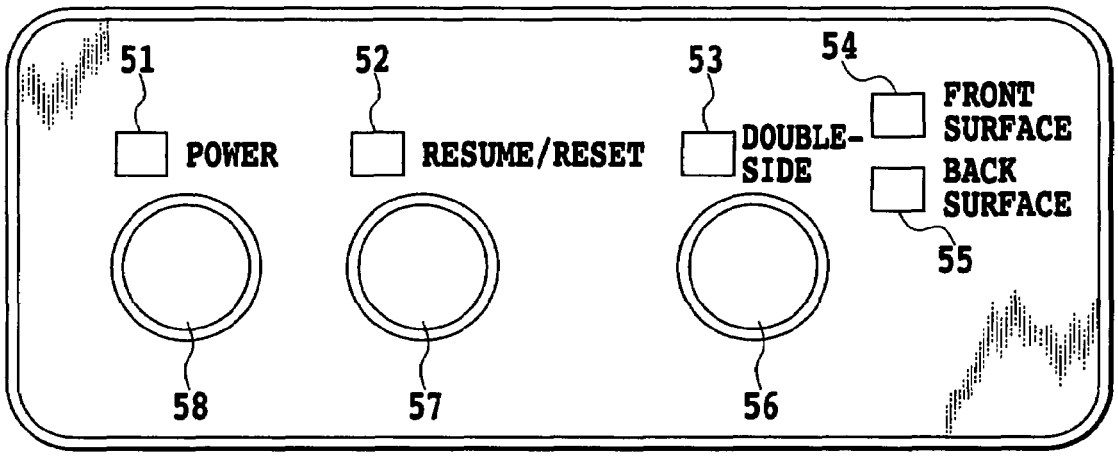
FIG. 5 is a plan view showing an operation panel in the embodiment of this invention.
Figure 6:
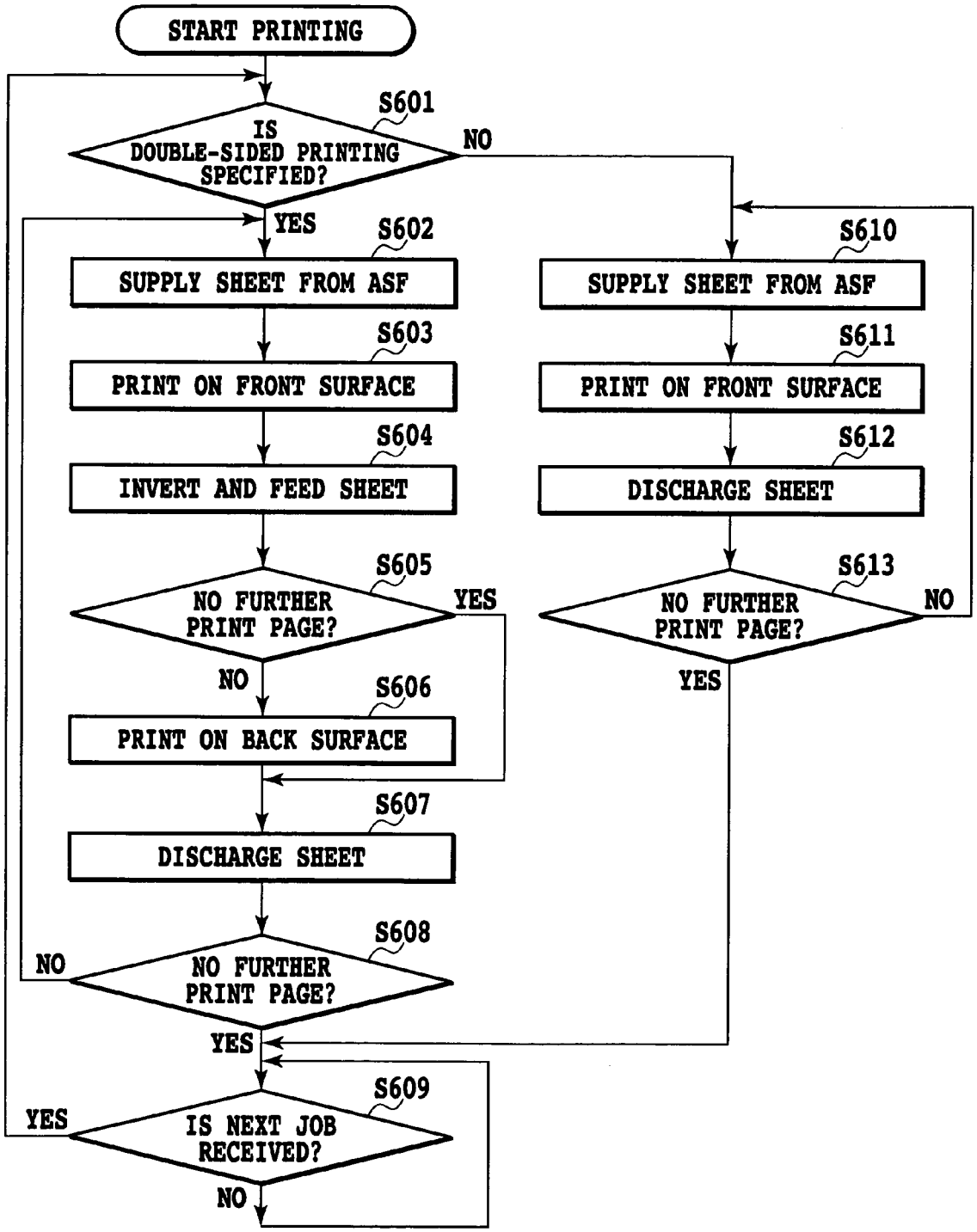
FIG. 6 is a flow chart showing a general control sequence executed by a printing apparatus capable of a conventional double-sided printing.

FIG. 5 shows a configuration of the operation panel 31.

The operation panel 31 has a power switch 58 for the printing apparatus; a power LED 51 indicating an on/off state of the power of the printing apparatus selected by the power switch 58; a resume/reset switch 57 to resume a suspended operation of the printing apparatus after the printing apparatus has failed or necessary recovery steps have been taken or to reset the state of the printing apparatus; a resume/reset LED 52 indicating whether a resume/reset operation is necessary; a double-sided printing selection switch 56 to select a double-sided printing as a print mode regardless of the content of a print job instructed by the host computer 25; a double-sided printing selection LED 53 indicating whether the double-sided printing is selected; and a front surface LED 54 and a back surface LED 55 indicating whether a front surface or a back surface of the print medium is being printed during the double-sided printing.

Figure 1:
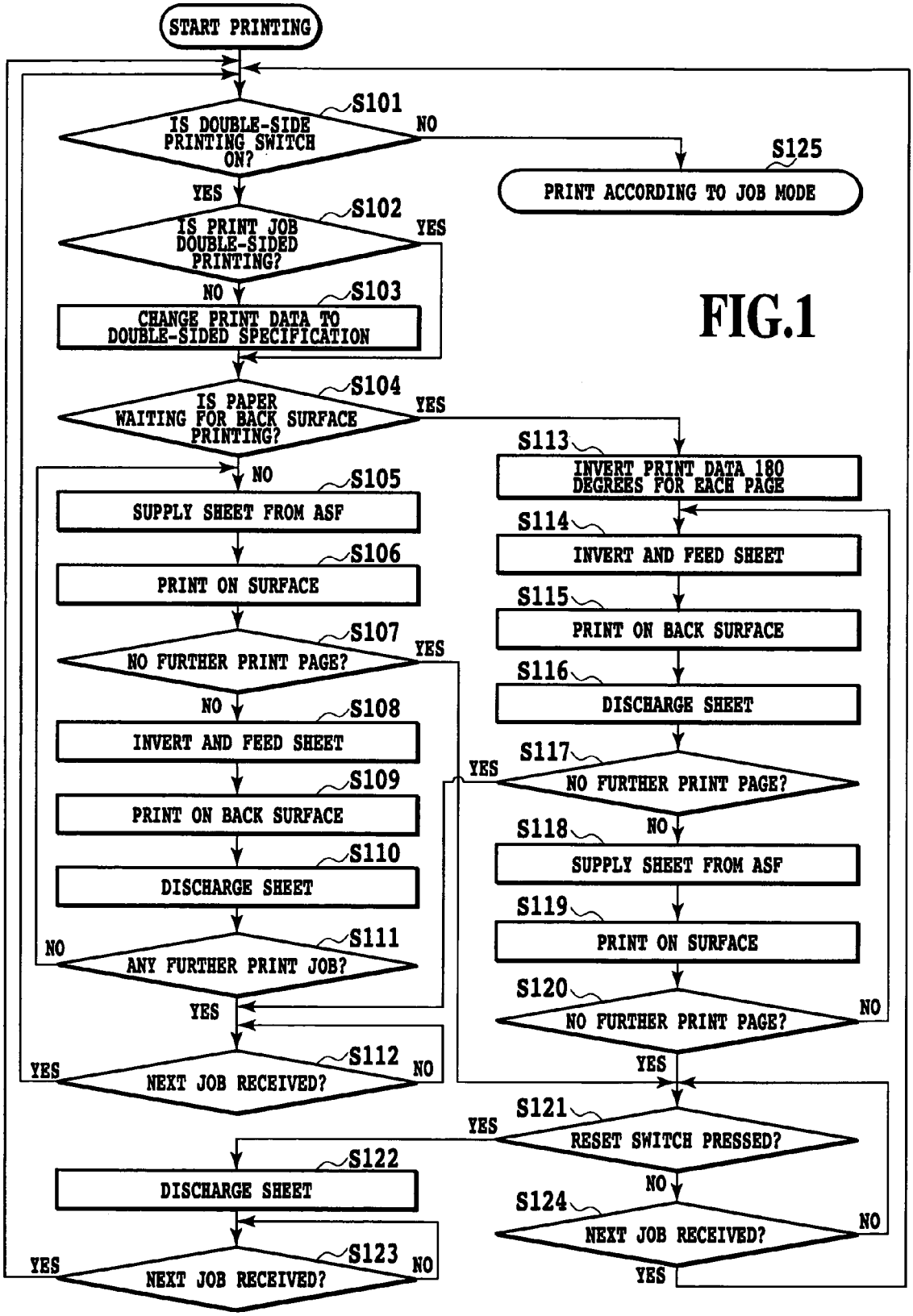
FIG. 1 is a flow chart showing a sequence of operations performed by a printing apparatus in an embodiment of this invention.

Next, the printing operation executed by the printing apparatus of this embodiment is explained by referring to the flow chart of FIG. 1.

When, with the power of the printing apparatus turned on, a print job (print command) is instructed by the host computer 25, the print job is transmitted through a printer driver 25*a* on the host computer 25. The print job is sent through the interface 27 and stored in a reception buffer in the RAM 29. The print job sent from the host computer to the printing apparatus includes a command instructing whether to execute a one-sided printing or a double-sided printing, a command associated with other printing operations and print data to be printed. The print data may cover a print area as large as more than one page of print medium. The print data is sent from the host computer 25 through the printer driver 25*a* and interface 27 and successively stored in the reception buffer in the RAM 29.

The control unit 22 of the printing apparatus first checks if the double-sided printing selection switch 56 is depressed to select the double-sided printing mode (S101). If it is decided that the double-sided printing selection switch 56 is depressed and that the double-sided printing is selected, the control unit 22 then checks if the print job instructed by the host computer 25 specifies the double-sided printing (S102). When it is decided that the print job does not specify the double-sided printing, the control unit changes the print job to the double-sided printing specification (S103). The double-sided printing specification means a printing specification which starts printing from the front end of odd-numbered pages and, for the even-numbered pages, reverses the print data 180 degrees and begins printing from the rear end of the page. In this specification, printing may be performed by reversing through 180 degrees the order of storing the print data for the even-numbered pages in the reception buffer, with respect to the order of storing the print data for odd-numbered pages, or by storing in the reception buffer the print data for both the odd-numbered pages and the even-numbered pages in the same order but reversing the order of reading the odd-numbered pages and the even-numbered pages from the reception buffer by 180 degrees.

Although the specification change operation may be done on the printing apparatus side as described above, it can also be performed on the host computer 25 side by giving the host computer 25 information that the double-sided printing selection switch 56 is depressed. In that case, the host computer 25 checks whether the double-sided printing is set. If the double-sided printing is found to be set, the print data for a plurality of pages included in the print job is changed to the double-sided printing specification and the modified print data is transferred from the host computer 25 to the printing apparatus one line at a time. The printing apparatus is provided with a reception buffer with a capacity large enough to receive at least one line of print data. The one line of print data received is stored in this reception buffer.

Next, a check is made as to whether, according to the print job that was executed immediately before a current print job being received, the last page print data has been printed on the front surface of the print medium, with the back surface printing kept standing by. That is, the control unit decides whether the print medium that was printed on the front surface is held between the discharge rollers 8, 9 and the discharge follower rollers 9, 11 and is waiting to be printed on its back surface (S 104). Then, if the print medium has been printed on both its front and back surfaces according to the immediately preceding print job and discharged onto the discharge unit and thus it is decided that no sheets exist in the transport path that are waiting for the printing operation, then another sheet of print medium is supplied by the supply roller 14 from the paper stacker 15 of an auto sheet feeder (ASF) that constitutes the paper supply unit (S 105). The print medium supplied by the supply roller 14 is transported by the rotating transport roller 6 and follower roller 7, the rotating first discharge roller 8 and first discharge follower roller 9, and the rotating second discharge roller 10 and second discharge follower roller 11. The newly supplied print medium is printed on its front surface by the print head 1 according to the current print job (S106).

After the front surface printing is completed, a check is made as to whether there is data for the next page in the RAM 29 or the reception buffer. That is, it is decided whether the current print job is finished at the end of this front surface printing operation (S107).

If the current print job still exists, the print medium that was printed on the front surface is transported in the opposite direction by reversing the rotation of the transport roller 6 and follower roller 7, the first discharge roller 8 and first discharge follower roller 9, and the second discharge roller 10 and the second discharge follower roller 11 and introduced into the reversing loop path 45. After this, the print medium is inverted, with its upper surface facing down and its front end facing rearward, and fed to the transport roller 6 (S108). The print medium is then printed on its back surface as it is transported by the transport roller 6 and follower roller 7, the first discharge roller 8 and first discharge follower roller 9 and the second discharge roller 10 and second discharge follower roller 11 (S109).

With the printing on the back surface completed, the print medium is fed onto the discharge unit of the printing apparatus by the first discharge roller 8 and first discharge follower roller 9 and the second discharge roller 10 and second discharge follower roller 11 (S110).

After this, with the print medium discharged, it is checked whether data for the next page exists in the RAM 29 as the reception buffer (S111). If the data exists, the sequence beginning with S105 is repeated. If step Sill finds no further data for the next page in the RAM 29 as the reception buffer, the control program waits for another print job (S112) and, when the next print job is demanded by the host computer 25, repeats the sequence beginning with S101.

In step S107, if, with the front surface printing completed, there is no print data for the next page in the RAM 29 as the reception buffer, it is decided that the current print job is finished. In this case, the control program waits for the next print job without discharging the print medium (S124). During this wait for another print job, it is monitored whether the resume/reset switch 57 is pressed (S121). If the resume/reset switch 57 is found to be depressed, the print medium is discharged (S122). After the resume/reset switch 57 has been depressed and the print medium discharged, the control program waits for another print job (S123). When the next print job is demanded by the host computer 25, the sequence beginning with S101 is again initiated.

The print medium discharge sequence that is executed upon the depressing of the resume/reset switch 57 assumes the following situation. That is, in the case where the double-sided printing selection switch 56 is pressed in the printing apparatus to make a setting that executes the double-sided printing irrespective of the printing specification of the print job so that a plurality of print jobs are executed successively, a situation is contemplated where, when a particular print job is completed, a sheet of print medium printed on only its front surface and kept standing by in the transport path is discharged so that the relevant printed sheets can be picked up as one printed document. For example, this sequence is effectively applied where one makes a search on the Web and wishes to finish the printing operation when the relevant home page data is printed out, in order to pick up the relevant printed data as one printed material.

In step S104, if, when a print job is demanded by the host computer 25, there is a print medium in the transport path waiting for the back surface printing, the print data is reversed 180 degrees as described earlier in order to begin with the back surface printing (S113).

The reversing of the print data is done so that the images printed on the front and back surfaces of the print medium are oriented in the same longitudinal directions. That is, when there is a print medium standing by in the transport path, print data for odd-numbered pages is printed on the back surfaces in the next print job. At this time, the odd-numbered pages are printed from the rear end, while the even-numbered pages are printed from the front end. Thus, reversing the print data enables the images printed on the front and back surfaces of the print medium to be oriented in the same longitudinal directions. This processing may be performed either by the host computer 25 by giving it information that the double-sided printing selection switch 56 on the printing apparatus is depressed, or by the printing apparatus.

Next in step S114, the print medium, that has finished the front surface printing and is standing by, is now fed in the opposite direction into the reversing loop path 45 by reversing the rotation of the transport roller 6 and follower roller 7, the first discharge roller 8 and first discharge follower roller 9, and the second discharge roller 10 and second discharge follower roller 11. In the reversing loop path 45 the print medium is inverted into a facedown orientation with the front end facing rearward and again fed to the transport roller 6 (S114). After this, the transport roller 6 and follower roller 7, the first discharge roller 8 and first discharge follower roller 9, and the second discharge roller 10 and second discharge follower roller 11 are rotated in the forward direction to advance the print medium as the print head 1 performs the printing scan to form an image on the back surface of the print medium (S115). When the back surface printing is complete, the forward rotation of the first discharge roller 8 and first discharge follower roller 9 and the second discharge roller 10 and second discharge follower roller 11 transports the print medium onto the discharge unit of the printing apparatus (S116).

After the discharge operation is finished, it is checked whether print data for the next page exists in the RAM 29 as the reception buffer (S117). If there is print data for the next page, another sheet of print medium is fed by the supply roller 14 from the paper stacker 15 in ASF as the paper supply unit (S118) and transported by the forward rotation of the transport roller 6 and follower roller 7, the first discharge roller 8 and the first discharge follower roller 9, and the second discharge roller 10 and second discharge follower roller 11 while at the same time it undergoes the front surface printing by the print head 1 (S119).

After the front surface printing is complete, a check is made as to whether there is print data for the next page in the RAM 29 as the reception buffer, in order to determine if the current print job is finished at the end of the front surface printing (S120). Here if there still is print data, the sequence beginning with S114 is repeated. If it is decided that the current print job is finished at S120, the print medium is not discharged but is kept waiting for the next print job (S124). If the resume/reset switch 57 is depressed before the next print job is received, the print medium is discharged (S121-S122).

Then, the control processing waits for the next print job (S123). When the next print job is demanded by the host computer 25, the sequence beginning with S101 is again initiated.

When step S117 decides that the print job is finished, the control processing waits for another print job (S112). When the next print job is demanded by the host computer 25, the sequence beginning with S101 is repeated.

When in S101, the double-sided printing selection switch 56 in the printing apparatus is found not depressed and the double-sided print mode is thus determined to be not selected, the printing operation is performed according to the printing specification of individual print jobs received (S125).

As described above, in the printing apparatus of this embodiment, it is possible to selectively execute either the first mode, which executes the one-sided printing or double-sided printing according to a print job, or the second mode, which always performs the double-sided printing irrespective of the content of print job.

Therefore, if a plurality of print jobs occur irregularly, a sheet of print medium is not discharged each time a print job is finished, so the double-sided printing can be executed consecutively for a plurality of print jobs. Thus, when the double-sided printing is set and if one-page print jobs are repetitively demanded, a sheet of print medium can be prevented from being discharged each time the one-page printing finishes as it has been with the conventional printing method, ensuring that the printing operation for two print jobs is reliably performed on both surfaces of each print medium. As a result, the amount of print medium consumed is reduced to almost one-half the amount consumed by the conventional method. It is also not necessary to successively store print jobs in a memory area in advance.

Further, when a double-sided printing is set, depressing the resume/reset switch 57 enables the double-sided printing to be terminated as desired. This substantially improves the ease of use on the part of the user, allowing for a printing operation that takes full advantage of the double-sided printing function provided in the printing apparatus.

In the above embodiment, an example case has been described in which the double-sided printing selection switch 56 is provided on the operation panel in the printing apparatus. The printer driver installed on the host computer 25 to receive print commands for the printing apparatus from the host computer 25 may of course be provided with a function similar to the double-sided printing selection switch 56.

It is also noted that the present invention is not restricted to a printing apparatus employing the ink jet printing system described in the above embodiment but is also applicable to printing apparatus using other printing systems, such as wire dot system, heat transfer system and laser beam printing system.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes.

This application claims priority from Japanese Patent Applications No. 2004-176209 filed Jun. 14, 2004, which is hereby incorporated by reference herein.

What is claimed is:

1. A printing apparatus comprising:

transport means for transporting a print medium along a transport path;

printing means for printing on the print medium at a predetermined print position in the transport path;

discharge means for discharging the print medium from the transport path; and double-sided printing control means for controlling the transport means, the printing means and the discharge means to execute a double-sided printing to print on a first surface and a second surface of the print medium;

wherein the double-sided printing control means can select between a first mode and a second mode, wherein, in the first mode, the double-sided printing control means discharges all print mediums that have been printed according to a first print job, wherein, in the second mode, when the printing of a last page of print data of the first print job is ended on the first surface of a print medium, the double-sided printing control means controls the discharge means not to discharge the print medium, and to hold the print medium, whose first surface was printed, in the transport path, and when a second print job is received, the double-sided printing control means controls the print means to print a first page of print data of the second print job on the second surface of the print medium held in the transport path.

2. A printing apparatus according to claim 1, wherein the double-sided printing control means can select between the first mode and the second mode by a predetermined specifying means.

3. A printing apparatus according to claim 1, wherein the print command includes at least a command specifying which of the first mode and the second mode is to be executed and print data to be printed on at least one of two surfaces of the print medium.

4. A printing apparatus according to claim 1, wherein, when the double-sided printing control means has the print medium, whose first surface was printed, stand by to wait for an input of the next print command, the double-sided printing control means reverses by 180 degrees print data for each print medium included in the next print command and starts printing on the second surface of the print medium that was standing by and whose first surface was printed.

5. A printing apparatus according to claim 1, wherein the transport path includes:

a first transport path through which to feed a print medium to the printing means so that the first surface of the print medium is printed by the printing means, and a second transport path in which the print medium whose first surface was printed is turned upside down before being fed to the printing means so that the second surface of the print medium whose first surface was printed can be printed by the printing means.

6. A printing apparatus according to claim 5, wherein the first path is a path ranging from a paper supply unit, which supplies print mediums one at a time, to the printing means to the discharge means, and the second path is a path ranging from the discharge means to the printing means to a reversing path, where a print medium is turned upside down, to the printing means again.

7. A printing apparatus according to claim 1, wherein, when the double-sided printing control means has the print medium stand by to wait for an input of the next print command, the print medium whose first surface was printed is stopped with one part thereof held by the discharge means.

8. A printing apparatus according to claim 1, further including an indication means to indicate whether the surface of the print medium that is being printed is the first surface or the second surface.

9. A printing apparatus comprising:

transport means for transporting a print medium along a transport path;

printing means for printing on the print medium at a predetermined print position in the transport path;

discharge means for discharging the print medium from the transport path; and double-sided printing control means for controlling the transport means, the printing means and the discharge means to execute a double-sided printing to print on a first surface and a second surface of the print medium;

wherein, the double-sided printing control means controls the transport means, the printing means and the discharge means so that, when the printing of a last page of print data based on a preceding print job is ended on the first surface of a print medium, the double-sided printing control means (1) controls the discharge means so as not to discharge the print medium, and to hold the print medium, whose first surface was printed, in the transport path and, (2) when a next print job is input, controls the printing means to print a first page of print data from the next print job on the second surface of the print medium held in the transport path.

10. A method for controlling a printing apparatus, wherein the printing apparatus includes:

transport means for transporting a print medium along a transport path; printing means for printing on the print medium at a predetermined print position in the transport path;

discharge means for discharging the print medium from the transport path; and double-sided printing control means for controlling the transport means, the printing means and the discharge means to execute a double-sided printing to print on a first surface and a second surface of the print medium;

the printing apparatus control method comprising the step of:

selecting one of a plurality of modes, including a first mode and a second mode, to execute the double-sided printing;

wherein the first mode is a mode in which all print mediums that have been printed according to a print job are discharged by the discharge means;

wherein the second mode is a mode in which, when the printing of a last page of print data from a first print job is ended on the first surface of a print medium, the print medium whose first surface was printed is not discharged by the discharge means and is held in the transport path to wait for an input of a second print job, and a first page of print data from the second print job is printed on the second surface of the print medium held in the transport path.

11. A method for controlling a printing apparatus, wherein the printing apparatus includes:

transport means for transporting a print medium along a transport path;

printing means for printing on the print medium at a predetermined print position in the transport path;

discharge means for discharging the print medium from the transport path; and double-sided printing control means for controlling the transport means, the printing means and the discharge means to execute a double-sided printing to print on a first surface and a second surface of the print medium;

the printing apparatus control method comprising the step of:

controlling the transport means, the printing means and the discharge means by the double-sided printing control means so that when the printing of a last page of print data of a first print job is ended on the first surface of a print medium, the print medium whose first surface was printed is not discharged by the discharge means but is held in the transport path to wait for an input of a second print job, and print data of the second print job is printed on the print medium held in the transport path.

* * * * *

UNITED STATES PATENT AND TRADEMARK OFFICE

CERTIFICATE OF CORRECTION

PATENT NO. : 7,401,914 B2
APPLICATION NO. : 11/146166
DATED : July 22, 2008
INVENTOR(S) : Katsuyuki Yokoi It is certified that error appears in the above-identified patent and that said Letters Patent is hereby corrected as shown below:

ON THE TITLE PAGE:
At Item (57) ABSTRACT, Line 7, "unit." should read --units.--.

COLUMN 2:
Line 24, "according" should read --according to--.

COLUMN 4:
Line 4, "forth" should read --fourth--.

COLUMN 5:
Line 43, "10" should be deleted.

COLUMN 6:
Line 27, "mean time," should read --meantime,--.

COLUMN 9:
Line 35, "step Sill" should read --step S111--.

COLUMN 11:
Line 46, "printing apparatus" should read --a printing apparatus--.
Line 54, "apparent" should read --appended--.

Signed and Sealed this

Seventeenth Day of February, 2009

JOHN DOLL
*Acting Director of the United States Patent and Trademark Office*